US007316078B2

(12) United States Patent
Hagman

(10) Patent No.: US 7,316,078 B2
(45) Date of Patent: Jan. 8, 2008

(54) PICTURE HANGER POSITIONING DEVICE

(76) Inventor: James U. Hagman, 15618 E. Tierra Rahada Rd., Moorpark, CA (US) 93021

( * ) Notice: Subject to any disclaimer, the term of this patent is extended or adjusted under 35 U.S.C. 154(b) by 241 days.

(21) Appl. No.: 11/136,300

(22) Filed: May 24, 2005

(65) Prior Publication Data

US 2006/0278804 A1 Dec. 14, 2006

(51) Int. Cl.
*G01D 21/00* (2006.01)

(52) U.S. Cl. ..... 33/613; 33/666; 248/544

(58) Field of Classification Search ..... 248/544, 248/475.1, 489, 493, 494, 497, 466, 637; 33/613, 563, 666, 520, 533, 574, 403, 485, 33/645; D8/14, 16, 373; D10/65, 71; 81/487, 81/489, 177.7, 177.8
See application file for complete search history.

(56) References Cited

U.S. PATENT DOCUMENTS 3,516,165 A * 6/1970 Pfeffer ..... 33/574
4,069,998 A 1/1978 Rytting
4,517,860 A * 5/1985 Dameron, Jr. ..... 81/487
D317,575 S * 6/1991 Ramsey ..... D10/71
5,069,411 A 12/1991 Murphy
5,180,135 A * 1/1993 Hindall ..... 248/544
5,509,213 A 4/1996 Kelly et al.
5,749,558 A 5/1998 Wallo
5,806,826 A 9/1998 Lemire
5,867,917 A 2/1999 Karon
5,921,518 A 7/1999 Bernardi
6,049,991 A * 4/2000 Gruenberg et al. ..... 33/613

FOREIGN PATENT DOCUMENTS

GB 2351660 A * 1/2001
GB WO03094673 A1 * 11/2003
GB 2400032 A * 10/2004

* cited by examiner

*Primary Examiner*—Gwendolyn Baxter
(74) *Attorney, Agent, or Firm*—Holland & Knight LLP; Richard E. Lyon, Jr.

(57) ABSTRACT

A device for use in positioning a picture hanger on a wall. The device includes an elongated body member, a handle carried by an upper portion of the body member, a picture hanger defining a lower open hook portion pivotally mounted on the body member below the handle and an aperture extending through the body member adjacent the hook portion of the picture hanger. Upon hanging a picture or other object from the picture hanger, positioning the device against the wall so as to properly locate the object thereon for hanging and removing the picture or object from the device, a marking implement can be inserted through the aperture to identify the proper position for the securement of a picture hanger to the wall.

4 Claims, 3 Drawing Sheets

PICTURE HANGER POSITIONING DEVICE

BACKGROUND OF THE INVENTION

The present invention relates to a device for use in hanging pictures and other objects and, more particularly, to a device for facilitating the proper positioning of a picture hanger on the wall. The hanging of a picture on the wall always requires the proper positioning of the picture and thus the proper positioning of the picture hanger. The task almost always requires some degree of guesswork, particularly when the picture is being hung using a wire, as one must precisely translate the elevation of the apex of the wire on the back of the picture to a corresponding location on the wall while supporting the weight of the picture and the location of the apex of the wire relative to the top of the picture frame will vary significantly from picture to picture depending on the size of the picture (or other object) and the tautness of the wire. The precise positioning of the picture hanger becomes particularly critical when a plurality of similarly-sized pictures or other objects are being hung in a horizontal row or other coordinated configuration. The location of the picture hanger frequently must be adjusted, leaving a number of unsightly nail holes in the wall behind the picture. As these holes must be spackled and painted when a picture is removed and not replaced, it would be highly desirable to provide a device which greatly facilitated the proper positioning of the hook in the first instance. It would also be highly desirable if such a device were simple to use and economical to manufacture. The picture hanger positioning device of the present invention obtains these results.

SUMMARY OF THE INVENTION

Briefly, the present invention is directed to a device for facilitating the securement of a picture hanger on a wall in the proper position so as to locate a picture or other object hanging therefrom in an exact desired position. The device generally comprises an elongated body member having a front surface and a rear surface. A picture hanger of the type having a lower open hook portion adapted to receive a portion of a wire, bar or other hanging attachment on the back of the picture is secured to the front surface of the body member proximate to the lower end thereof. A handle is attached to the front surface of the body member above the picture hanger, and an aperture extends through the body member adjacent to the lower hook portion of the picture hanger.

By hanging a picture or other object from the hanger on the body member and holding the body member and attached object against a vertical wall by means of the handle, the positioning of the picture is easily adjusted by moving the device about the wall until the desired picture location is obtained. At least a portion of the rear surface of the body member is planar to facilitate the controlled sliding movement of the device along the wall while adjusting the location of the picture or other object being carried thereby. Preferably, a protective backing is provided on the rear surface of the body member which provides a slight resistance to sliding movement against the wall to facilitate a controlled movement of the device along the wall in the positioning of the picture hanger.

When the desired position of the picture or other handing object is located, the device is held in place against the wall, the object is removed and the proper positioning of the hook portion of the picture hanger on the device is translated to the wall by simply extending a pencil or other marking device through the aligned aperture in the body member so as to mark the wall at the desired location for the hook portion of the picture hanger to be used in hanging the picture or other object. The device is then removed from the wall and the picture hanger to be used is nailed into the wall so that the hook portion thereof is adjacent the marked location on the wall.

It is the principle object of the invention to provide a device for facilitating the proper positioning of a picture hanger on a wall which is easy to use, of simple construction and economical to manufacture.

These and other objects and advantages of the present invention will become readily apparent from the following detailed description taken in conjunction with the accompanying drawings.

DETAILED DESCRIPTION OF THE PREFERRED EMBODIMENT

Figure 1:
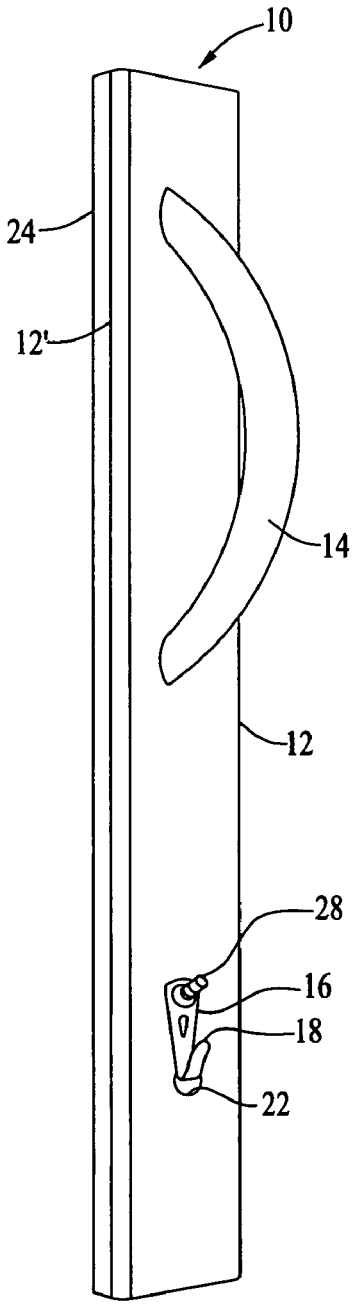
FIG. 1 is a perspective view of the positioning device of the present invention.

Referring now in detail to the drawings, the picture hanger positioning device 10 of the present invention comprises an elongated body member 12 provided with a handle 14 secured to an upper portion of the front surface thereof and a picture hanger 16 secured to a lower portion of the front surface of the body member. The picture hanger 16 defines an open hook portion 18 at its lower end that is adapted to receive and support a conventional picture frame wire or bar (not shown) attached to the backside of the picture or other object 20 to be hung on the wall. An aperture 22 extends through the body member 12 of the positioning device 10 adjacent to the hook portion 18 of the picture hanger 16 as seen in FIG. 1. While device 10 could be used in hanging pictures and a variety of other objects on a wall, the term "object" will be used herein to include all such items to simplify the description of the invention.

The back surface 12' of the body member 12 is preferably planar to facilitate the controlled sliding movement of the device 10 along a wall. A backing 24 preferably is provided on the rear planar surface of body member 12 so as to prevent marring of the wall as the device is slidably moved about the wall to properly position the object 20, as will be described. The backing 24 also should allow for the device to be controllably moved along the wall to facilitate the proper positioning of the object. The backing should have a coefficient of friction sufficient to provide a slight resistance to the sliding movement of the device along the wall so as to allow for a controlled sliding movement of the device. It should not generate such friction against the wall that it would be difficult to controllably slide the device along the wall to make minor, but significant, adjustments in position; nor should the backing be so slick that it would be difficult to maintain the proper positioning of the device 10 against the wall during and following the removal of the object from the device, as will also be described. A felt material provides this desired slight resistance and is well suited for backing 24. A plastic or other suitable protective material providing this slight resistance also could be utilized.

Figure 2:
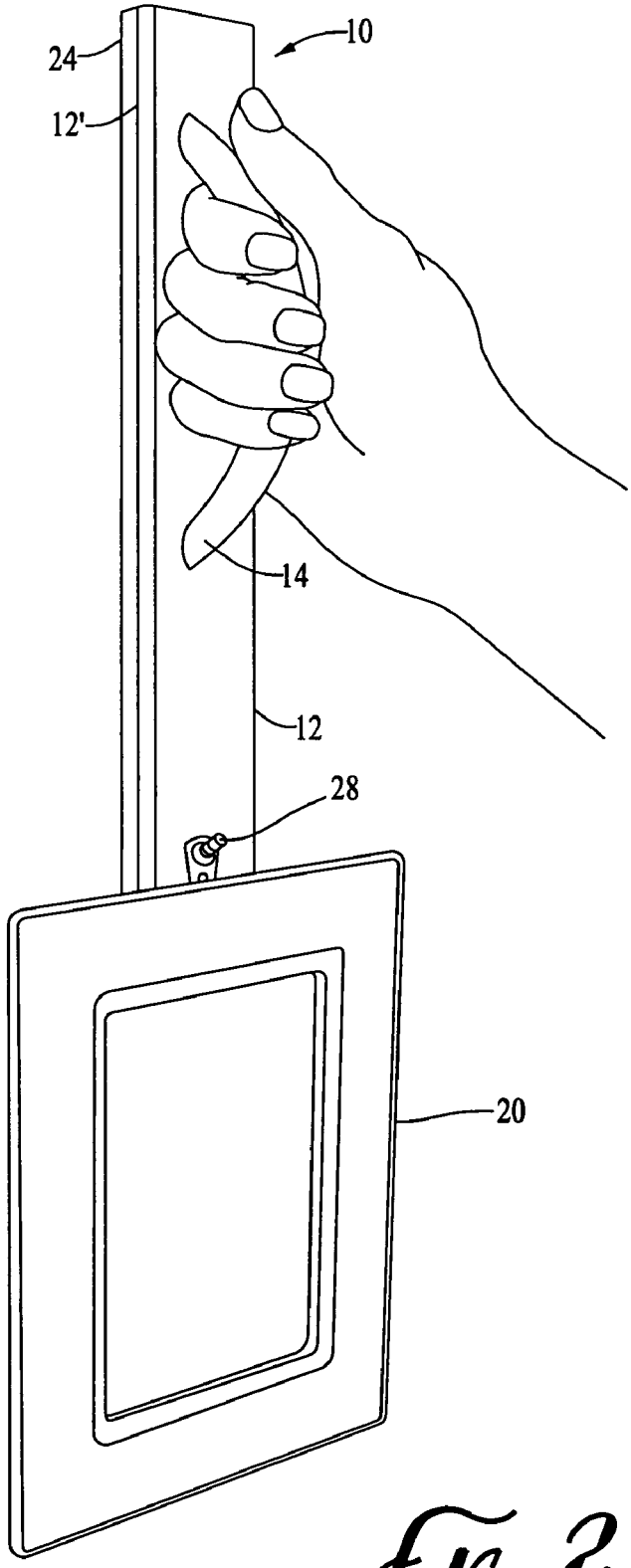
FIG. 2 is a perspective view illustrating the use of the present invention to properly position a picture on a wall.
Figure 3:
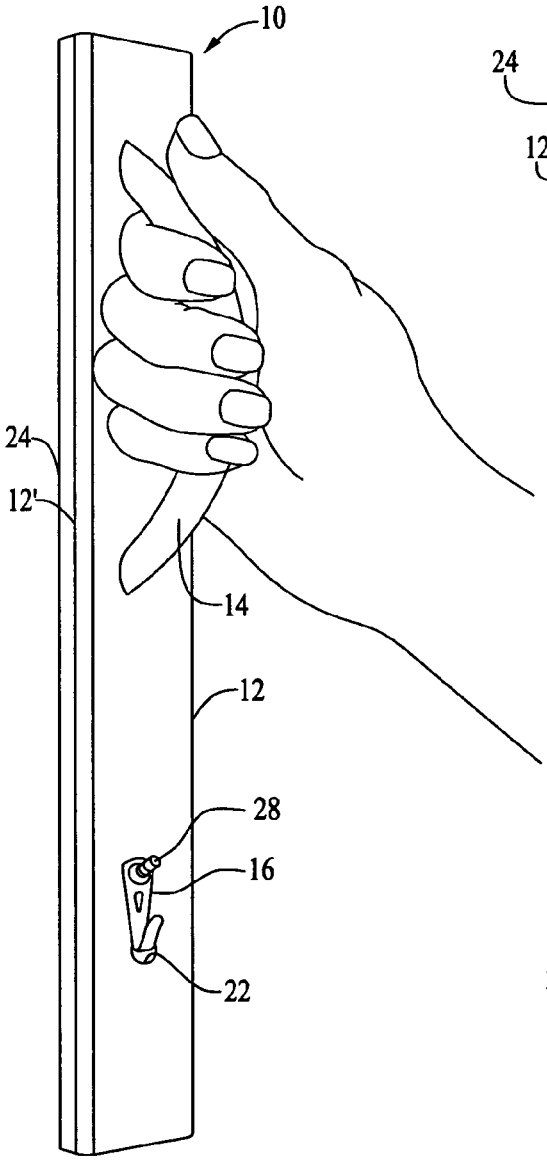
FIG. 3 is a perspective view of the device of the present invention held in place against a wall after the position of the hanger has been determined and the picture removed.
Figure 4:
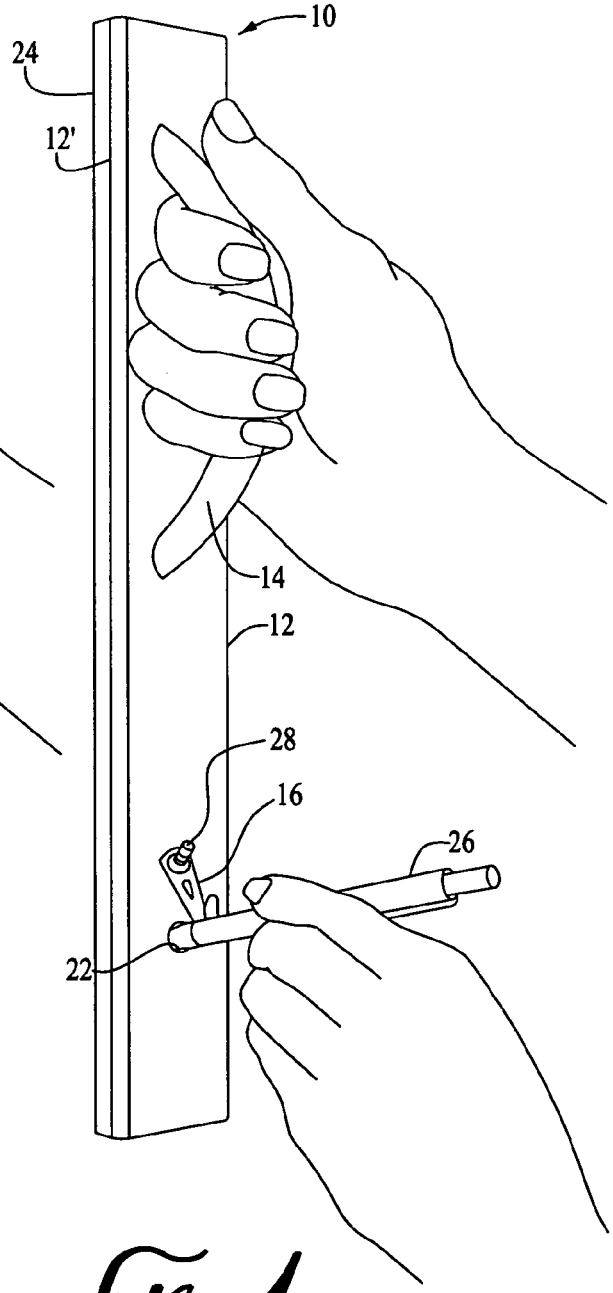
FIG. 4 is a perspective view of the device of the present invention illustrating the use of the device to mark the desired position for the picture hanger on the wall.
Figure 5:
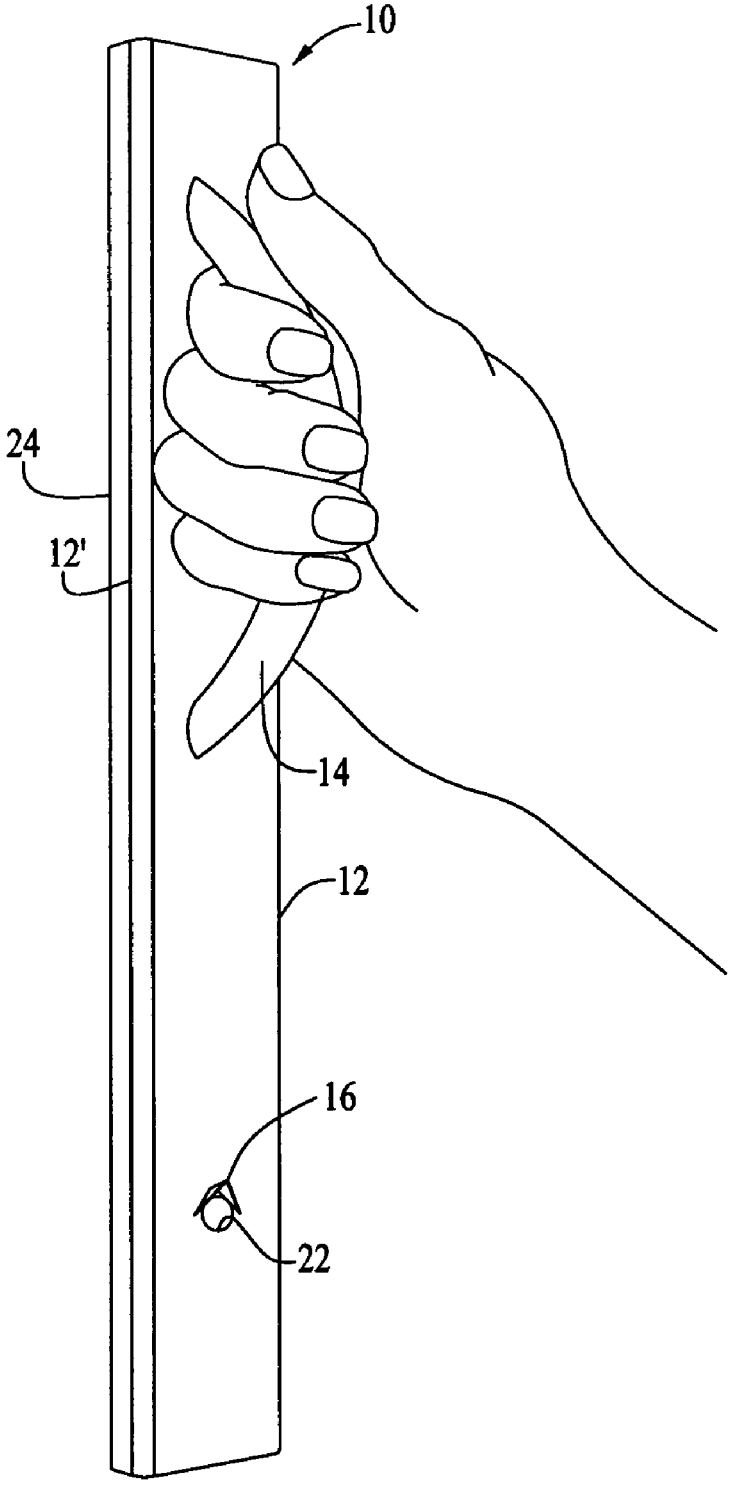
FIG. 5 is a perspective view of an alternate embodiment of the present invention.

In use, the object 20 to be hung on the wall is attached to the hook portion 18 of the picture hanger 16 on the front surface of the device and the device is held against the wall by handle 14 as illustrated in FIG. 2. The handle 14 enables the user to slidably move the device about the wall until the precise location for the picture is determined. The object 20 is then removed from the hanger 16 while holding the positioning device 10 in place against the wall as illustrated in FIG. 3. While continuing to hold the positioning device in place, the desired precise location of the picture hanger is translated to the wall using a pencil, pen or other marking device 26 as illustrated in FIG. 4. As seen therein, the marking implement 26 is simply inserted through the properly positioned aperture 22 in the body member 12, which corresponds to the exact location of the hook portion 18 of hanger 16. As illustrated in FIG. 4, the hanger 16 is preferably pivotally mounted proximate its upper end 28 on the body portion 12 so that the lower portion of the hanger may be simply moved to the side to facilitate the insertion of the writing implement through the aperture and thus obtain a precise marking of the hook location on the wall. Alternatively, the body member 12 could be provided with a fixed picture hanger 16. For example, the body member could define an outwardly projecting inverted V-shaped hanger immediately above aperture 22 so as to extend about an upper portion of the aperture as illustrated in FIG. 5. Other configurations of the picture hanger 16 could also be employed. Further, if desired, the location of the device 10 on the wall could be recorded on the wall prior to the removal of the object 20 to facilitate repositioning the device 10 following removal of the object from the picture hanger 16. For example, two small dots could be placed on the wall at the upper corners of the body member 12 so that if the device were inadvertently moved during the removal of the object therefrom, the proper positioning of the aperture 22 could be readily reestablished. Such a procedure would be particularly beneficial when attempting to hang larger or heavier objects.

Various changes and modifications can be made in the present invention without departing from the spirit and scope thereof. Insofar as such changes and modifications are within the purview of the appended claims, they are to be considered as part of the present invention.

I claim:

1. A device for use in positioning a picture hanger on a wall such that an object to be carried by the picture hanger will be in a desired position on the wall, said device comprising: a body member; a handle carried by said body member; a picture hanger defining a hook portion and being pivotally mounted on said body member below said handle; and an aperture extending through said body member adjacent to said hook portion of said picture hanger and communication a location of said hook portion of said picture hanger on said body member with a corresponding location on the wall whereby said corresponding location can be identified by moving said hook portion from said position adjacent said aperture so as to provide unobstructed access to said aperture and inserting a writing implement through said aperture and marking said corresponding location.

2. The device of claim 1 wherein said body member defines a back surface, at least a portion of said back surface being planar and including a layer of protective material secured to said planar portion of said back surface, said material allowing said body member to be slidably moved against the wall without marring the wall and while providing a slight resistance to said sliding movement to facilitate holding said device in a stationary position against the wall to allow accurate marking of said corresponding location on the wall.

3. A device for use in positioning a picture hanger on a wall such that an object to be carried by the picture hanger will be in a desired position on the wall, said device comprising: a body member; a handle carried by said body member; a picture hanger defining a hook portion and being moveably mounted on said body member below said handle; and an aperture lower portion of said front surface in substantial axial alignment with said handle, said picture hanger defining a lower open hook portion, an aperture extending through said body member adjacent said hook portion of said picture hanger and communicating a location of said hook portion of said picture hanger on said body member with a corresponding location on the wall whereby said aperture communicating the location of said hook portion of said picture hanger on said body member with a corresponding location on the wall whereby said corresponding location can be identified by moving said hook portion from said said aperture and marking said corresponding location on the wall. position adajacent said aperture so as to provide unobstructed access to said aperture and inserting a writing implement through said aperture and marking said corresponding location.

4. The device of claim 3 wherein said body member defines a back surface, at least a portion of said back surface being planar and including a layer of protective material secured to said planar portion of said back surface, said material allowing said body member to be slidably moved against the wall without marring the wall and while providing a slight resistance to said sliding movement to facilitate holding said device in a stationary position against the wall to allow accurate marking of said corresponding location on the wall.

* * * * *